US005634587A

United States Patent [19]

Popat et al.

[11] Patent Number: 5,634,587

[45] Date of Patent: Jun. 3, 1997

[54] COMPUTER PRINTABLE DUAL NO. 10 ENVELOPE ASSEMBLY

[75] Inventors: Ghanshyam H. Popat, Alta Loma; Anahit Tataryan, Temple City, both of Calif.; Frank H. Gavrilos, Milford, Mass.

[73] Assignee: Avery Dennison Corporation, Pasadena, Calif.

[21] Appl. No.: 500,517

[22] Filed: Jul. 11, 1995

[51] Int. Cl.[6] ..... B65D 27/10

[52] U.S. Cl. ..... 229/69

[58] Field of Search ..... 229/69, 72

[56] References Cited

U.S. PATENT DOCUMENTS

| | | | |
|---|---|---|---|
| 693,624 | 2/1902 | Sallade | 229/69 |
| 722,038 | 3/1903 | Pidgeon | 229/69 |
| 761,912 | 6/1904 | Rheutan | 229/69 |
| 1,611,585 | 12/1926 | Forman | 229/69 |
| 3,263,576 | 8/1966 | Ellenbogen . | |
| 3,273,784 | 9/1966 | Porter | 229/69 |
| 3,534,887 | 10/1970 | Ginsberg . | |
| 3,554,447 | 1/1971 | Sebring | 229/69 |
| 3,980,006 | 9/1976 | Welch | 229/69 |
| 4,032,065 | 6/1977 | Heimann | 229/69 |
| 4,084,741 | 4/1978 | Heimann | 229/69 |
| 4,138,014 | 2/1979 | Bouman . | |
| 4,305,503 | 12/1981 | Membrino . | |
| 4,458,466 | 7/1984 | Carbone et al. . | |
| 4,600,141 | 7/1986 | Bradley et al. | 229/69 |
| 4,711,686 | 12/1987 | Instance . | |
| 4,712,729 | 12/1987 | Craig | 229/69 |
| 4,784,317 | 11/1988 | Chen et al. . | |
| 4,807,805 | 2/1989 | Rutkowski . | |
| 4,878,613 | 11/1989 | Badger et al. . | |
| 4,984,733 | 1/1991 | Dunn, Jr. . | |
| 5,087,238 | 2/1992 | Olson . | |
| 5,183,436 | 2/1993 | Shanley | 229/69 |
| 5,388,699 | 2/1995 | Ratajezak et al. . | |

FOREIGN PATENT DOCUMENTS

| | | | |
|---|---|---|---|
| 985081 | 3/1965 | United Kingdom | 229/69 |
| 984917 | 3/1965 | United Kingdom | 229/69 |

*Primary Examiner*—Stephen P. Garbe
*Attorney, Agent, or Firm*—Oppenheimer Poms Smith

[57] ABSTRACT

A computer printer or copier compatible dual envelope assembly is provided for convenience in addressing two No. 10 envelopes (4⅛ inches by 9½ inches, or about 4×9 inches), with the assembly being in the order of 8½ inches wide and having a length at least equal to the length of said envelopes and with the envelopes extending in the longitudinal direction of said assembly.

8 Claims, 5 Drawing Sheets

FIG. 6
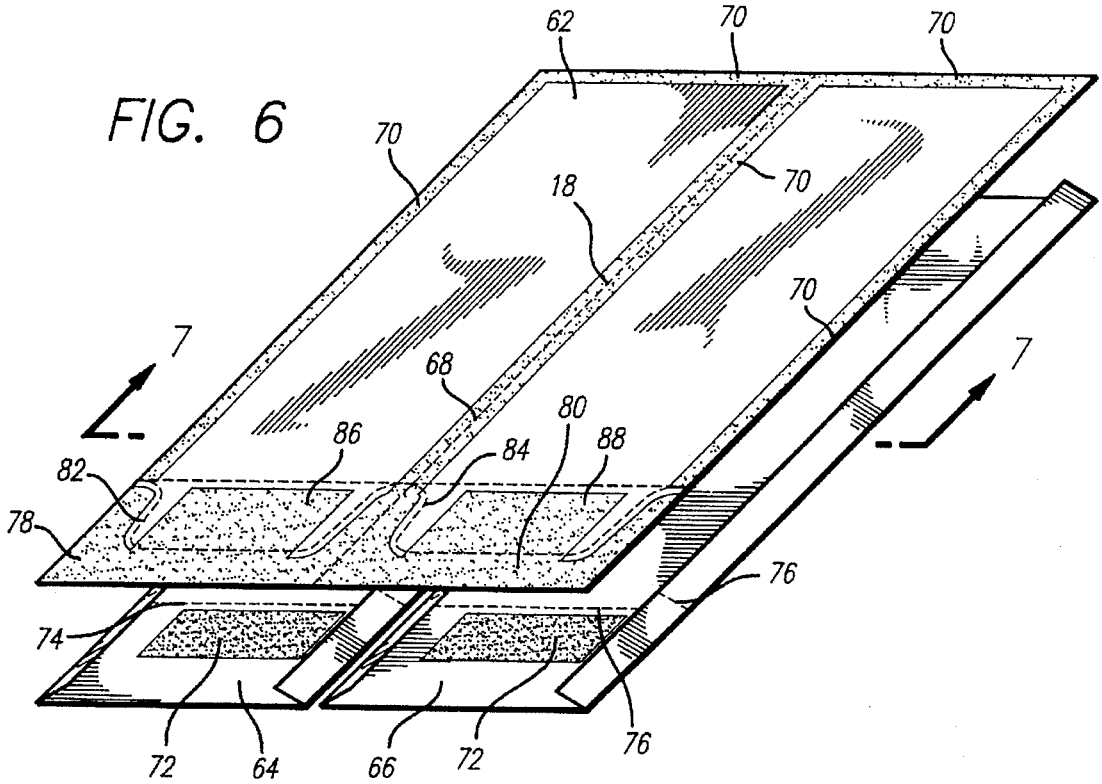
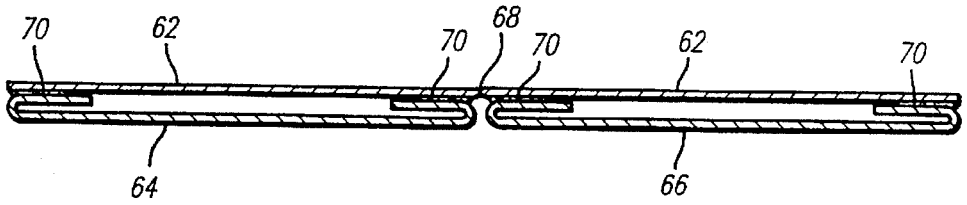
FIG. 7

FIG. 10
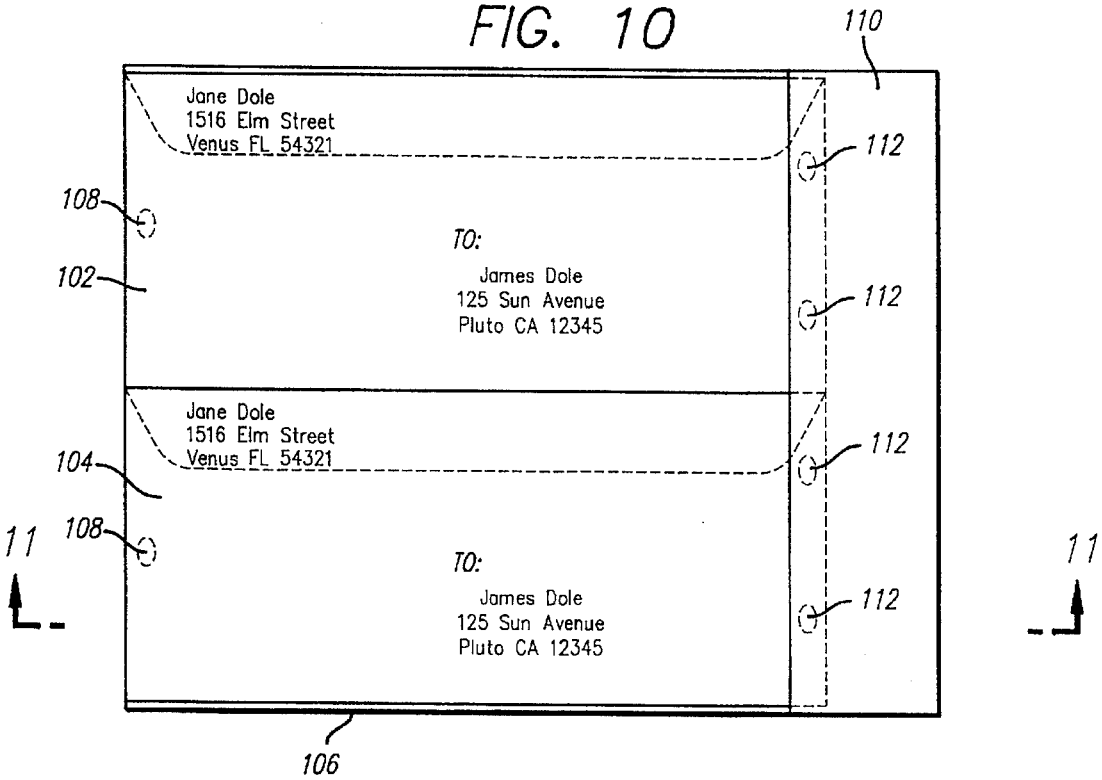
FIG. 11
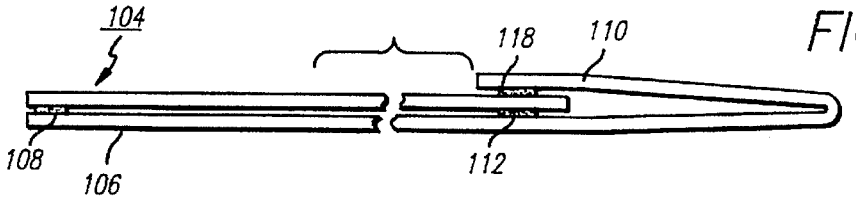
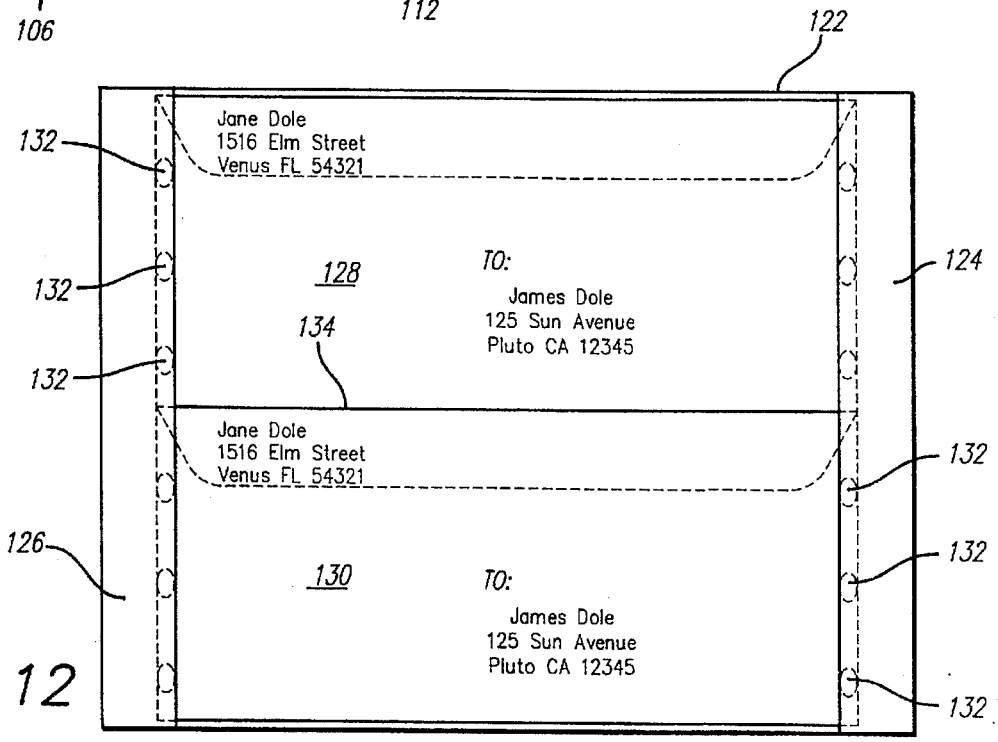
FIG. 12

COMPUTER PRINTABLE DUAL NO. 10 ENVELOPE ASSEMBLY

FIELD OF THE INVENTION

This invention relates to laser printable envelopes.

BACKGROUND OF THE INVENTION

In this age of computer printers, such as laser jet printers and ink Jet printers, the addressing of envelopes remains a problem. In some offices, secretaries keep a typewriter on hand just for addressing envelopes, for example. Computer printers usually work best with 8½ by 11 inch or longer sheets, although some feed trays are equipped with moveable guides for handling reduced width stock such as envelopes. However, for the printing of substantial numbers of envelopes, it would be desirable to use 8½×11 inch or longer sheets.

One widely used envelope is the so-called No. 10 envelope which is 4⅛ inches wide and 9½ inches long. It would be desirable to provide computer printable No. 10 envelopes.

One prior art patent, W. L. Rutkowski, U.S. Pat. No. 4,807,805, granted Feb. 28, 1989 and entitled "Dual Envelope Sheet-Fed Assembly," shows two envelopes formed on a double thickness sheet, with the envelopes extending across in the narrower direction of the sheet. As mentioned above, many computer printers will not accept paper significantly wider than 8½ inches, and thus would not accommodate sheets as disclosed in this patent if the envelopes were intended to be No. 10 envelopes, which would have a length for the envelopes of 9½ inches, defining the minimum size of the shorter dimension of the sheet.

SUMMARY OF THE INVENTION

Accordingly, an important object of the invention is to provide a computer or copier compatible multiple envelope sheet for forming No. 10 or similar size envelopes.

In accordance with one broad aspect of the invention, a computer printer or copier compatible dual envelope sheet assembly for forming two addressed No. 10 envelopes includes upper sheet material, and lower sheet material secured to said upper sheet material for form two No. 10 envelopes, with said dual envelope sheet assembly being approximately 8½ inches wide and at least 9½ inches long, with the envelopes extending in the longitudinal direction of said dual envelope sheet, and with the envelopes being secured together for printing but readily separable for separate loading and mailing.

In accordance with one aspect of the invention, the envelopes may be open at one end, with longitudinally extending flaps having an adhesive coating for sealing the envelopes.

In accordance with another aspect relating to certain embodiments of the invention, the two envelopes may be secured together by microperforations and accompanying ties extending longitudinally down the center of the dual envelope sheet assembly.

A feature of at least one embodiment of the invention is the initial formation of the envelopes by adhesively bonding along the longer edges thereof with adhesive.

One embodiment of the invention involves the use of a single sheet folded to form one end closure of each envelope and to form both the upper and lower sheet material.

An advantage of several embodiments of the invention is that the two envelopes may be addressed concurrently in a computer printer with the address printing being oriented in the same direction for both letters.

Also, in one embodiment of the invention, the flap of one of the envelopes may be tacked to the lower edge of the other envelope by a temporary or fugitive adhesive, so that the two envelopes form the dual envelope sheet assembly.

In accordance with another broad aspect of the invention, a computer printer or copier compatible dual envelope assembly for addressing two No. 10 envelopes comprises first and second No. 10 envelopes, said envelopes being secured together, with said assembly being approximately 8½ inches wide and at least 9½ inches long, and including both envelopes extending in the longitudinal direction of the assembly, with the envelopes being secured together for printing but readily separable for separate loading and mailing.

In accordance with one feature, fugitive adhesive may be employed to either secure the envelopes directly together or to a carrier sheet.

In accordance with another aspect of the invention, the envelopes may be provided with water activated adhesive for sealing the envelopes, using a high temperature stable adhesive for avoiding contamination of the printer. Alternatively, the adhesive for sealing the envelope flaps may be heat resistant through the use of co-adhesive materials, or through the use of pressure sensitive adhesive material having a liner covering the adhesive.

Other objects, features and advantages of the invention will become apparent from a consideration of the following detailed description and from the accompanying drawings.

BRIEF DESCRIPTION OF THE DRAWINGS

FIGS. 6 and 7 show a further alternative embodiment of the invention;

FIGS. 9–11 show a further embodiment of the invention in which a carrier sheet is employed; and FIG. 12 shows a carrier sheet embodiment, in which the carrier sheet extends over both ends of the envelopes.

DETAILED DESCRIPTION OF PREFERRED EMBODIMENTS OF THE INVENTION

Figure 1:
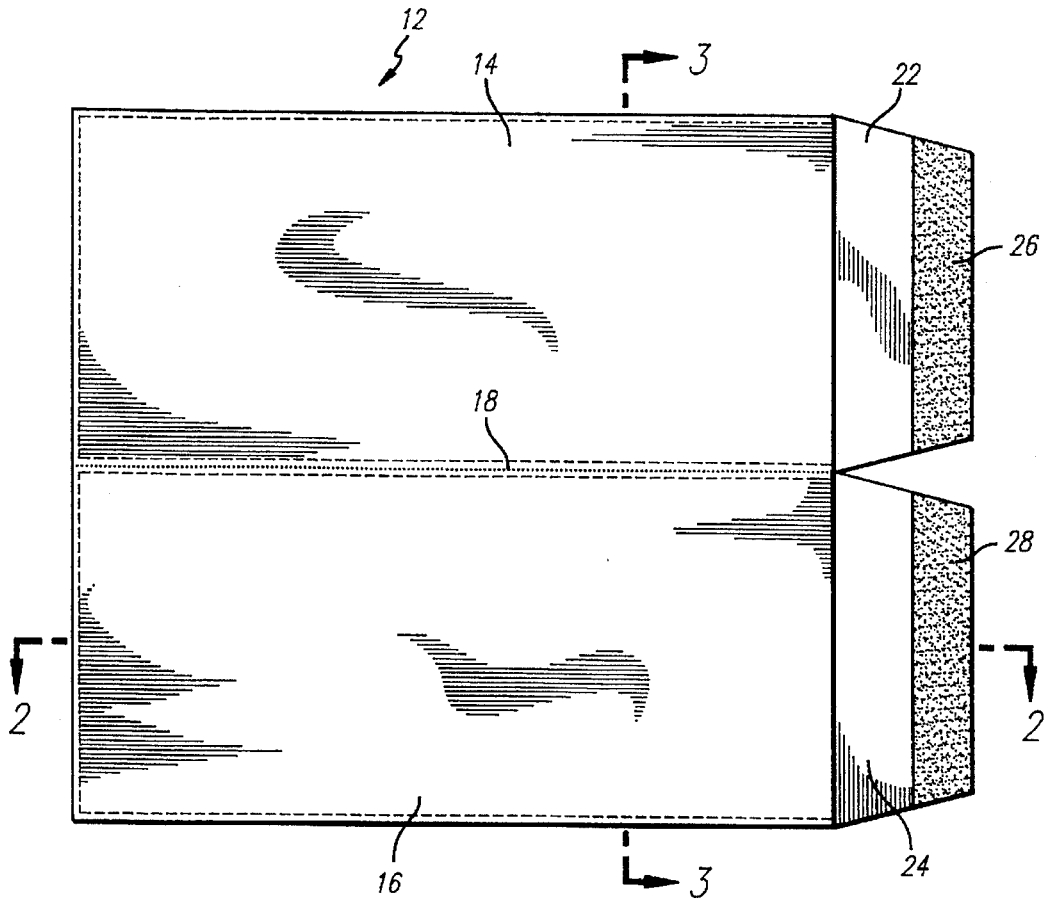
FIG. 1 is a plan view of a dual envelope assembly illustrating the principles of the present invention.
Figure 2:
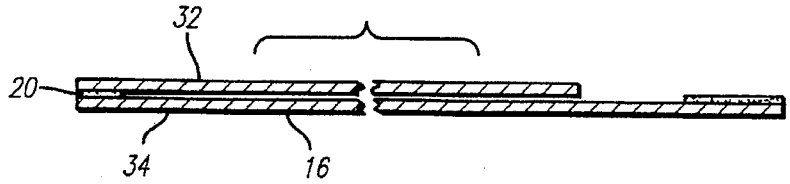
FIG. 2 is a partial cross sectional view takes along lines 2—2 of FIG. 1.
Figure 3:
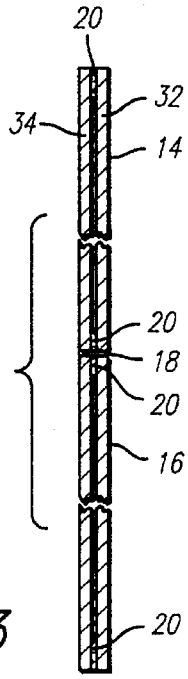
FIG. 3 is a partial cross sectional view taken along lines 3—3 of FIG. 1.

Referring now to the drawings, FIG. 1 shows a first embodiment of a dual No. 10 envelope assembly in accordance with the present invention. More specifically, the assembly 12 includes an upper envelope 14 and a lower envelope 16 secured together along the center line by microperforations 18. The envelopes are sealed at their upper edges, at their lower edges and on either side of the microperforations 18 by permanent adhesive 20, as best shown in FIG. 3. Similarly, the rear edges of the envelopes 14 and 16 are sealed by a thin adhesive stripe 20, as shown in FIG. 2. The envelopes 14 and 16 are open at one end for loading, and are provided with flaps 22, 24 for sealing the envelopes. The flaps 22, 24 are provided with adhesive 26, 28, which is heat resistant, but which may be moisture activated.

As noted above, the adhesive material 26, 28 is a stable, water activated or moisture activated adhesive which is not significantly affected by either heat or exposure to high humidity. In this regard, it is noted that so-called "natural" gum adhesives are not suitable for this purpose, as the relatively high heat of a few hundred degrees to which the paper is subject in a laser printer or by the hot rollers of a xerographic copying machine, will produce contamination to the printer or the copier from adhesives such as natural gum. There are known adhesives which are moisture activated and are relatively stable in that they are not activated by temperatures of a few hundred degrees, or relatively high humidity conditions. One such adhesive is available from Adhesives Consultants Corporation, 25817 Clawiter Road, Hayward, Calif. 94545, under the tradename "Adcon FS-6." This adhesive is a polyvinyl emulsion. As noted above, other stable, moisture activated adhesives are known and such other adhesive may be employed. In addition, if desired, the envelopes 14, 16, of FIG. 1 may be sealed by co-adhesive materials coated on both the envelope and also on the flap, so that they are only activated when the two types of materials are pressed together. Alternatively, the flaps 22 and 24 may be provided with pressure sensitive adhesive, spaced back from the edges of the flap, and covered with a light weight "liner" material for use while the envelope assembly is passing through a laser printer. Later when the envelopes are loaded and are ready to be sealed, the liner is pulled off and the flaps 22, 24, with the exposed pressure sensitive material is folded into engagement with the backs of the envelopes which are facing up in the showing of FIG. 1.

It may be noted that the assembly of FIGS. 1–4 is actually formed of two sheets of paper, each of which is approximately 8½×11" in size, with the upper sheet being designated by the reference numeral 32 and the lower sheet designated by the reference numeral 34 as shown in FIGS. 2 and 3. These two sheets 32 and 34 are held together by permanent high temperature resistant adhesive 20, as discussed hereinabove, and this permanent adhesive is of the type which will not ooze or otherwise be affected by the temperatures of a few hundred degrees often encountered in laser printers or xerographic copiers.

Incidentally, the line of perforations 18 is preferably of the very fine type of perforations known as "microperforations" in which the cuts and intervening ties are spaced very close together in the order of more than 30 cuts and ties per inch, and preferably more than 50 cuts and ties per inch, so that the resulting surface is very smooth and does not feel rough as might be the case with ordinary perforations.

Figure 4:
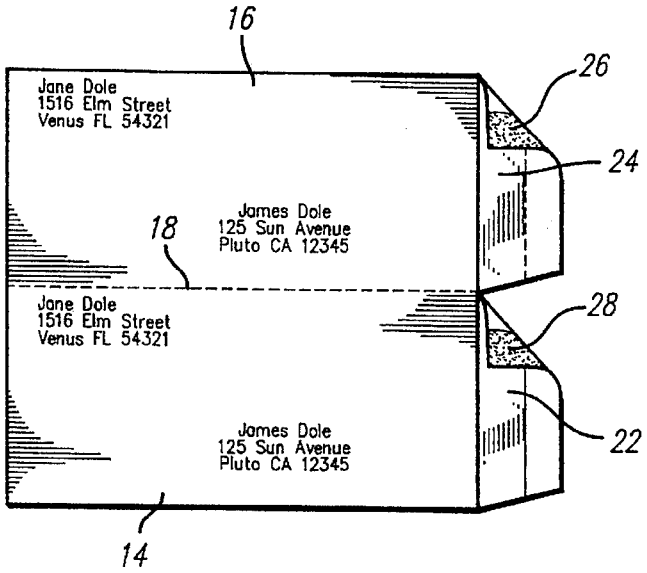
FIG. 4 shows the dual envelope assembly of FIG. 1 onto which addresses have been applied.

FIG. 4 shows the front of envelope 16, 14, as compared with FIG. 1 which showed the rear surface of the envelopes to which the flaps 22, 24 would be secured. In FIG. 4, the flaps seal the envelopes by being folded backward into the paper as shown in FIG. 4 to eventually seal the envelopes. As shown in FIG. 4, the addresses on the faces of the envelopes may be printed in the laser printer or ink jet printer, or on the xerox machine with the printing oriented in the same direction for both envelopes. Subsequently to printing the envelopes, they may be separated along the microperforations 18 to form two distinct envelopes each of which may then be loaded, and sealed.

Figure 5:
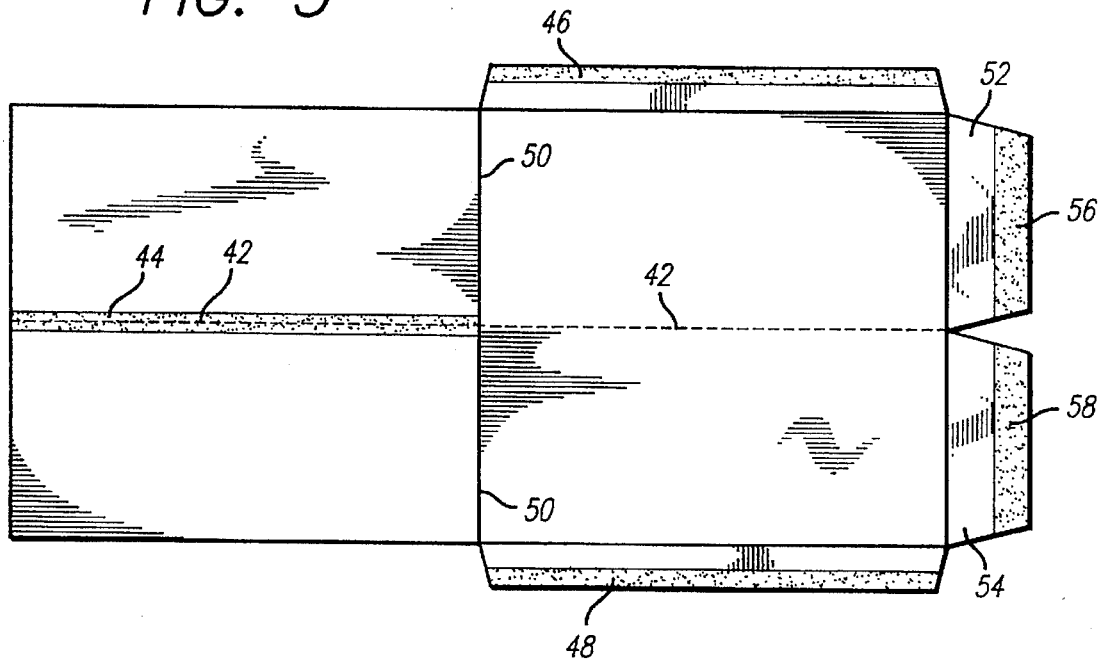
FIG. 5 shows an alternative embodiment of the invention.

FIG. 5 shows an alternative embodiment of the invention in which a single longer sheet is folded to make two No. 10 envelopes, each of which measures approximately 4⅛×9½". In FIG. 5, a central line of microperforations 42 extends for the full length of the sheet. A high temperature stable, heat resistant permanent adhesive is located in the areas 44, 46, and 48, to form the dual envelope assembly. A single sheet is folded about the line 50 so as to form the closed end of the envelope. The flaps 52 and 54 are left open, while the envelopes are being addressed, and then, following loading of the envelopes, they are sealed. The adhesive 56, 58 is a high temperature stable heat resistant adhesive which is preferably water moistenable, as discussed hereinabove. Alternatively, the co-adhesive or the use of pressure sensitive adhesive with a liner, may be employed.

In practice, the dual envelope assembly of FIG. 5 is prepared for printing by folding the portion of the sheet to the left of the fold line 50 in FIG. 5 over to the right, and the two flaps 46 and 48 are then sealed over the inwardly folded back sheet, to form two envelopes, with the microperforations 42 between these two envelopes. Then, following printing, the envelopes are separated and loaded, after which the tabs or flaps 52 and 54 are sealed shut.

FIG. 6 shows another alternative embodiment of the invention in which an upper sheet 62, and lower sheets 64 and 66 are employed. Extending down through the center of the upper sheet 62 are the microperforations 68. The upper and lower sheets are held together by the adhesive coating 70. For convenience in illustration, the adhesive material 70 is shown on the upper surface of the upper sheet 62, but it is actually on the lower surface of sheet 62, as better shown in FIG. 7. The ends of the envelopes shown at the upper right in FIG. 6 are permanently sealed together, while the ends at the lower left are open for loading.

Concerning the open end of each of the envelopes, the upper surfaces of the lower sheets 64 and 66 may be provided with areas of silicone release material 72 to ensure that there is no adherence to the adhesive on the lower surface of the upper sheet 62. The ends of the lower sheets 64 and 66 are then removed by separation along the microperforation lines 74 and 76. The lower left hand ends of the sheet 62 are formed into two sealing flaps by removing the areas 78 and 80 along the microperforation lines 82 and 84. Following loading of the envelopes, after separation along the microperforation line 68, the envelopes may be sealed by moistening the adhesive areas 86 and 88. With the flaps carrying the adhesive material 86 and 88 being moistened and folded down over the lower portion of each of the sheets 64, 66, the envelopes may then be mailed. Incidentally, of course, the upper surface of the sheet 62, constituting the front of each envelope, will have been previously addressed in a printer.

Figure 8:
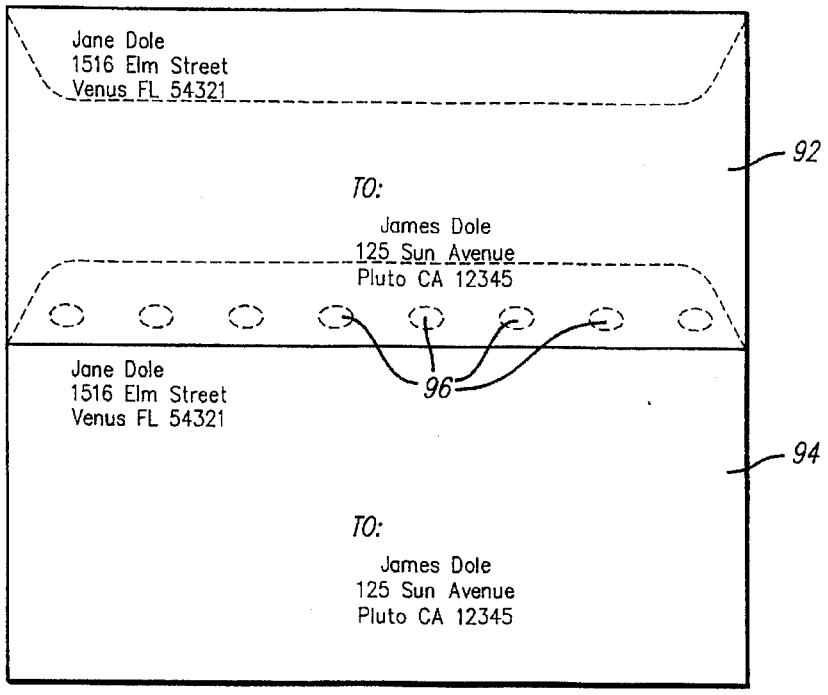
FIG. 8 shows an additional embodiment of the invention in which two envelopes are directly secured together.

FIG. 8 represents yet another embodiment of the invention in which two ordinary No. 10 envelopes 92 and 94 may be secured together by dots of fugitive adhesive 96 which are located on the flap of the lower envelope 94, holding this flap to the rear side of the envelope 92. "Fugitive" adhesive is a well known type of adhesive which is employed for the temporary bonding of paper, and, following one use, virtually disappears when the two sheets of paper are pulled apart. Two sources of fugitive adhesives are Pafra fugitive adhesive type BR4297, with Pafra, Inc. being located at 260 Route 46 East, Fairfield, N.J. 07004; and Swift Type 98341 fugitive adhesive with Swift Adhesives being a division of Reichold Chemicals Inc. located at 3100 Wood Creek Drive, P.O. Box 1456, Downers Grove, Ill. As in prior cases, the flaps on the envelopes 92 and 94 would be provided with a high temperature stable adhesive of any of the types mentioned hereinabove. Incidentally, the two envelopes as shown in FIG. 8, each of which has a height of about 4⅛ inches, may be held together by the fugitive adhesive 96 so that the assembly is 8½ inches by 9½ inches in overall measurements.

Figure 9:
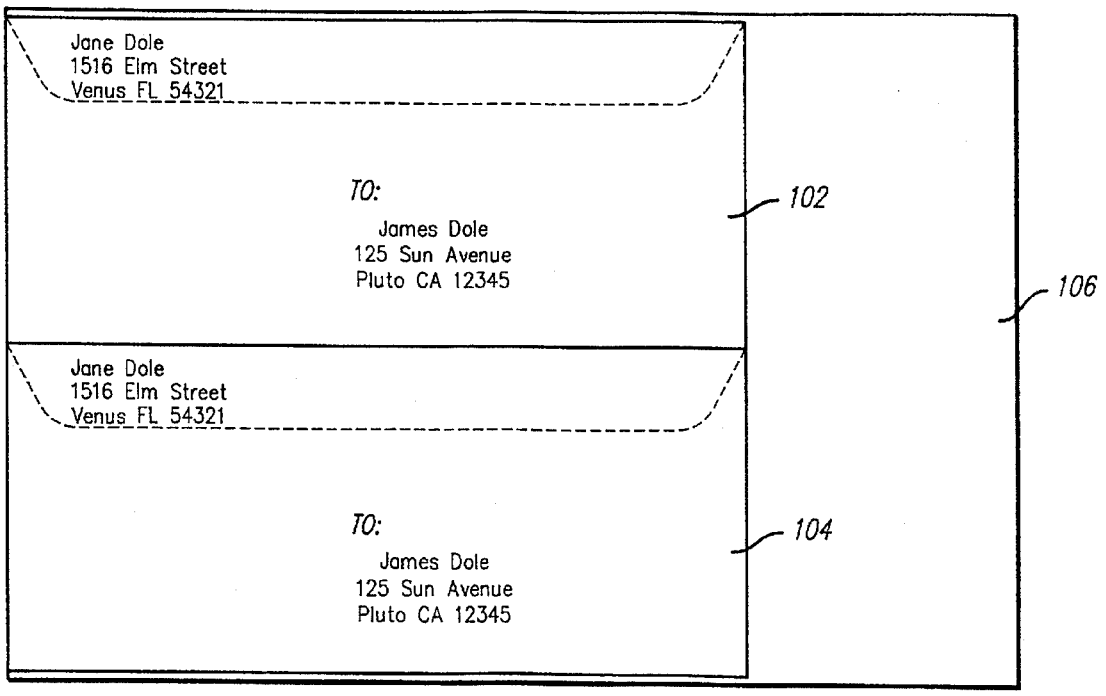

The embodiment of FIGS. 9–11 uses two standard No. 10 envelopes 102 and 104, mounted on a carrier sheet 106. Each of the two No. 10 envelopes 102 and 104 measures 4⅛×9½", and the sheet 106 may have an overall size of 8½×13", as shown in FIG. 9, prior to folding. As shown in FIGS. 10 and 11, the envelopes 102 and 104 may be secured to the carrier sheet 106 by dots of fugitive adhesive 108 which are located at the left hand end of the dual envelope assembly. In addition, the right hand end of the carrier sheet 106 may be folded over as indicated at 110 to form a folded sheet which is 8½×11" in size. Accordingly, the overlapping area 110 which is folded back over the ends of envelopes 102, 104, may be 2" in length, and can be secured to envelopes 102, 104 by fugitive adhesive 118. This aspect is best shown by FIG. 11, which shows the envelope as a single layer for the sake of simplicity. The bracket in FIG. 11 indicates that the envelopes are much longer than shown in FIG. 11. Additional dots 112 of fugitive adhesive may be provided to secure the envelopes to the carrier sheet. In use, the folded over end of the assembly of FIG. 10 would be fed through the printer first.

FIG. 12 shows an alternative embodiment of the invention using a carrier sheet 122, with its two ends 124, 126 folded back over the ends of the two No. 10 envelopes 128, 130. The two No. 10 envelopes 128, 130 may be separate and held in place by the dots of fugitive adhesive 132.

In the foregoing detailed description and in the accompanying drawings, certain preferred embodiments of the invention have been shown and described, for facilitating the printing of a pair of No. 10 envelopes in printers, such as laser or ink jet printers, or in xerographic copying machines. However, it is to be understood that various modifications and alterations may be accomplished by those skilled in the art without departing from the spirit and scope of the present invention. Specifically, the concept involves the printing of two No. 10 envelopes which are normally 4⅛" by 9½" mounted together in an assembly, so that they may be readily printed in a laser printer, an ink jet printer or other computer printer or xerographic copier. In particular, various arrangements using fugitive adhesive, microperforations, and similar constructional features as described herein, along with heat resistant adhesives are contemplated. Accordingly, the present invention is not limited to the precise embodiments described hereinabove and shown in the drawings.

What is claimed is:

1. A computer printer or copier compatible dual envelope sheet assembly for use in a copier or printer to produce two addressed No. 10 envelopes, comprising:

a first No. 10 envelope;

a second No. 10 envelope;

a carrier sheet secured by fugitive or temporary adhesive to said first and second No. 10 envelopes, whereby said first and second No. 10 envelopes are secured together for printing but readily separable for separate loading and mailing;

said dual envelope sheet assembly being approximately 8½ inches wide and at least 9½ inches long, and including said first and second No. 10 envelopes both extending longitudinally along said dual envelope assembly; and whereby the two No. 10 envelopes may be printed in a computer printer with a substantially 8½ inch wide capacity feed tray.

2. A dual envelope sheet as defined in claim 1 wherein said envelopes include high temperature stable water activated adhesive for sealing said envelopes.

3. A dual envelope sheet assembly as defined in claim 1 with addresses printed on said envelopes in the longitudinal direction and with the printing for addresses on both envelopes being right side up when both envelopes are viewed from one side of said dual envelope sheet.

4. A dual envelope assembly as defined in claim 1 wherein said carrier sheet is folded over at least one end of both envelopes and is adhesively secured to both sides of each envelope.

5. A dual envelope assembly as defined in claim 4 wherein fugitive adhesive is employed to adhesively secure said envelopes to said carrier sheet.

6. A computer printer or copier compatible dual envelope sheet assembly for use in a printer or copier to produce two addressed No. 10 envelopes, comprising:

upper sheet material forming the front of two envelopes;

lower sheet material secured to said upper sheet material and forming the back of two envelopes;

said dual envelope sheet assembly being approximately 8½ inches wide and at least 9½ inches long, and constituting two No. 10 envelopes extending longitudinally along said dual envelope sheet;

said two envelopes being secured together for printing but readily separable for separate loading and mailing; and said envelopes being side loaded and being secured to a carder sheet by temporary adhesive;

whereby the two No. 10 envelopes may be printed in a computer printer with a substantially 8½ inch wide capacity feed tray.

7. A dual envelope sheet assembly as defined in claim 6 with addresses printed longitudinally along said envelopes and with the printing for addresses on both envelopes being right side up when both envelopes are viewed from one side of said dual envelope sheet.

8. A dual envelope sheet as defined in claim 6 wherein said envelopes include high temperature stable water activated adhesive for sealing said envelopes.

* * * * *